US005821484A

United States Patent [19]

Schulze et al.

[11] Patent Number: 5,821,484

[45] Date of Patent: Oct. 13, 1998

[54] SAFETY SWITCH

[75] Inventors: Klaus Schulze, Radevormwald; Siegfried Schulz, Huckeswagen, both of Germany

[73] Assignee: K.A. Schmersal GmbH & Co., Wuppertal, Germany

[21] Appl. No.: 598,372

[22] Filed: Feb. 8, 1996

[30] Foreign Application Priority Data

Feb. 14, 1995 [DE] Germany ..... 195 04 744.3

[51] Int. Cl.[6] ..... H01H 27/00

[52] U.S. Cl. ..... 200/17 R; 200/43.07; 200/61.62

[58] Field of Search ..... 200/17 R, 43.01, 200/43.04–43.09, 50.09, 50.01, 50.02, 61.62, 61.68, 61.71, 334, 302.2, 518, 533, 537, 573, 574, 324, 325

[56] References Cited

U.S. PATENT DOCUMENTS

| | | | |
|---|---|---|---|
| 3,875,353 | 4/1975 | Mardach | 200/8 A |
| 4,135,069 | 1/1979 | Piber | 200/67 G |
| 4,163,127 | 7/1979 | Herou | 200/61.47 |
| 4,658,102 | 4/1987 | Seim et al. | 200/17 R |
| 4,963,706 | 10/1990 | Mohtasham | 200/334 |
| 5,420,385 | 5/1995 | Cooper | 200/43.07 |
| 5,464,954 | 11/1995 | Kimura et al. | 200/61.62 |
| 5,516,993 | 5/1996 | Wecke et al. | 200/17 R |
| 5,587,569 | 12/1996 | Mohtasham | 200/17 R |

FOREIGN PATENT DOCUMENTS

| | | | |
|---|---|---|---|
| 2550880 | 2/1985 | France | H01H 13/18 |
| 2655187 | 5/1991 | France | H01H 27/00 |
| 1 959 469 | 6/1971 | Germany | H01H 3/16 |
| 38 19 753 A1 | 12/1989 | Germany | H01H 3/16 |
| 40 31 348 A1 | 4/1991 | Germany | F16P 3/10 |
| 39 43 376 | 6/1991 | Germany | F16P 3/10 |
| 43 03 367 C1 | 2/1994 | Germany | H01H 27/00 |

OTHER PUBLICATIONS

European Search Report for European Patent 96 10 1571, dated May 23, 1996.

*Primary Examiner*—Michael L. Gellner
*Assistant Examiner*—Michael A. Friedhofer
*Attorney, Agent, or Firm*—Alix, Yale & Ristas, LLP

[57] ABSTRACT

A safety switch, operable by a removable coded actuator, is designed for mounting on a support surface in four different orientations. The switch has a substantially square cross-section and grooves or holes for receiving mounting fasteners extend across each side of the switch housing, the grooves being located in a common plane intermediate the ends of the housing.

21 Claims, 5 Drawing Sheets

SAFETY SWITCH

BACKGROUND OF THE INVENTION

1. Field of the Invention

The present invention relates to access control and, particularly, to the prevention of the unauthorized operation of machinery. More specifically, this invention is directed to improvements in safety switches and, especially, to code "key" operated safety switches which may be easily mounted in a plurality of different orientations. Accordingly, the general objects of the present invention are to provide novel and improved methods and apparatus of such character.

2. Description of the Prior Art

Electrical safety switches having a reciprocally mounted contact carrier to which movement is imparted by means of an encoded actuating roller are known in the art. In such known switches, rotational movement is imparted to the roller by means of a properly coded mechanical actuator, i.e. a "key", which is inserted into the switch housing via an opening. Rotational motion of the actuating roller, produced by linear directed force transmitted via the mechanical actuator, is translated into reciprocal motion of the contact carrier with a resultant change in the state of the switch contacts.

U.S. Pat. No. 4,558,102 discloses an exemplary prior art safety switch of the type briefly described above. The switch of U.S. Pat. No. 4,658,102 has a cuboid housing of rectangular cross-section. An actuating roller assembly is mounted within this housing and is coupled to a reciprocal plunger "tappet" which forms part of the carrier for the movable contacts of the switch. When the actuating roller is "unlocked" by the insertion of a properly coded actuator, the actuating roller may be rotated about its axis and this rotational motion is translated into linear motion of the tappet and thus motion of the movable switch contacts. The configuration of the actuating roller and the location of the orifices through which the mechanical actuator may be introduced into the housing, so as to be operatively coupled to the roller, are such that the switch may be operated from either of two opposite sides or an end face of the housing, the actuator introduction orifices typically being in the form of slots. The actuator introduction orifices are provided in a cap which is removably attached to the main housing of the switch, the orientation of the cap being determined by the requisite or desired installation position of the switch. The installation position is determined by mounting holes which extend from a front side of the main housing to the rear side thereof. While a safety switch of the type disclosed in U.S. Pat. No. 4,658,102 presents several installation alternatives, manipulation of the cap is generally required if the mounting orientation is to be changed. Further, and most importantly, a mounting alternative wherein the housing is rotated through an angle of 90° about its longitudinal axis is not possible without the use of an additional housing carrier which must be installed on the support surface to which the switch is to be fastened.

Published German Patent Application 3,330,109 discloses another safety switch of the type generally discussed above. The safety switch of this published application is provided with a cap having four slot-like actuator introduction orifices. In this case, manipulation of the cap to reconfigure the safety switch to each desired mounting orientation is not required. However, the elimination of the need to reconfigure has been accomplished at the expense of the added complexity of an actuating roller which is rotatable in two directions. Further, the installation alternative of rotation of the switch housing through an angle of 90° about its longitudinal axis is still not possible without the use of the above-discussed additional housing carrier. As a further "deficiency", in some operating environments it has been found necessary to provide a dust guard or other closure for the actuator introduction orifices which are not to be used, i.e., the addition of two "key" introduction slots significantly increases the possibility of contamination with concomitant switch failure.

SUMMARY OF THE INVENTION

The present invention overcomes the above-briefly discussed and other deficiencies and disadvantages of the prior art by providing a novel and improved safety switch having the maximum number of installation alternatives without imposing the requirement of mechanical modification or conversion of the switch.

A safety switch in accordance with the present invention is characterized by a square-section when viewed in a direction transverse to its longitudinal axis. The switch housing is provided, approximately midpoint along its length and in a plane transverse to the longitudinal axis, with a fastener receiving recess or through-hole on each side. These fastener receiving recesses extend the length of their respective sides and are open at their opposite ends.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 2:
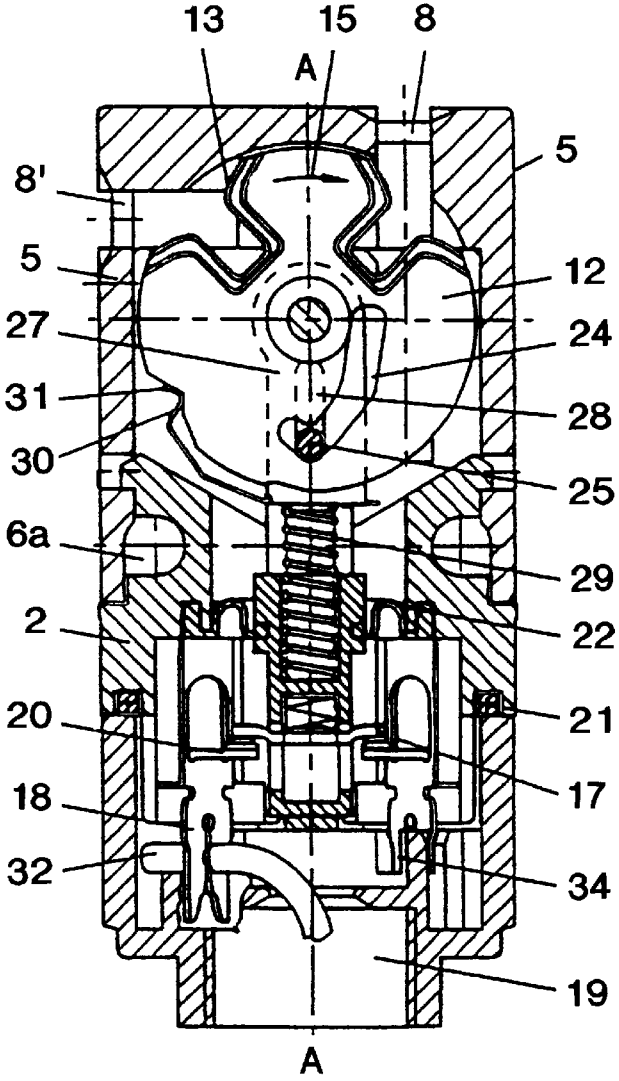
FIG. 2. is a cross-sectional side elevation view of the switch of FIG. 1, FIG. 2 being a view taken transversely with respect to that of FIG. 1 and depicting the switch with an alternative form of housing end cap.

With reference initially to FIGS. 1–4, a safety switch in accordance with the invention comprises a housing, indicated generally at 1, which defines a longitudinal axis A—A. The housing 1 includes a central or main portion 2, a lower end cap or cover 4 and an upper end cap 5. The lower cover 4 is affixed to the main housing portion 2 by means of screws 3 while the upper end cap 5 engages main portion 2 by means of cooperating ribs and grooves, i.e., end cap 5 is snap-fit onto main housing portion 2 as best seen from FIG. 2. Housing 1 has a generally square cross-section when viewed in a direction transverse to longitudinal axis A—A.

Figure 1:
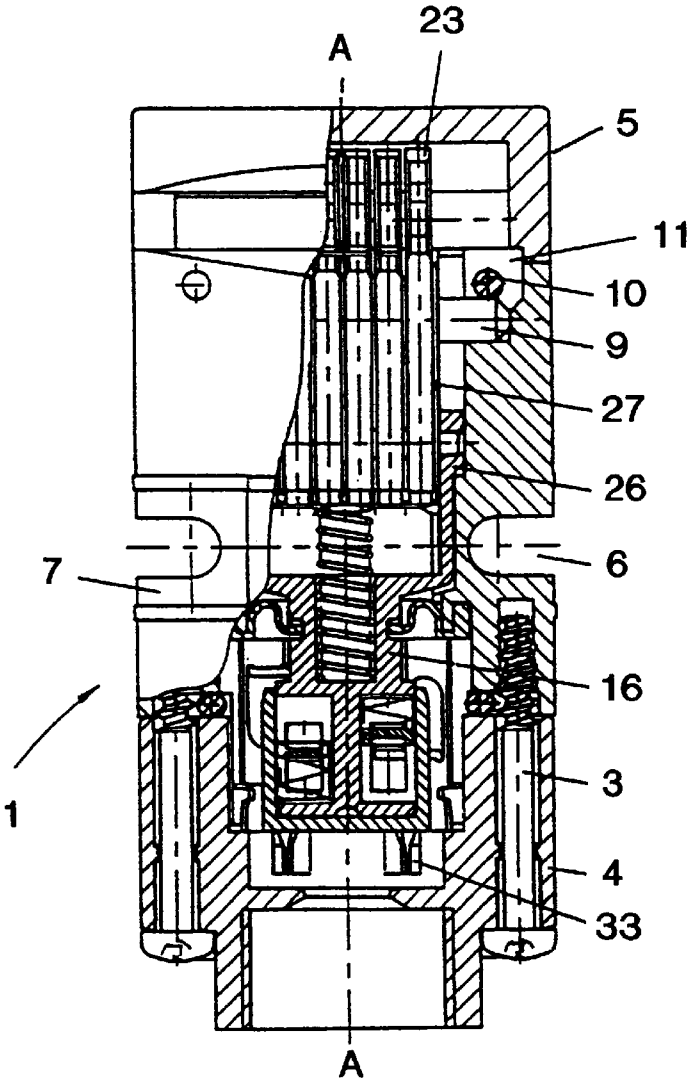
FIG. 1. is a side elevation view, partly broken away and partly in section, of a safety switch in accordance with a first embodiment of the invention.
Figure 3:
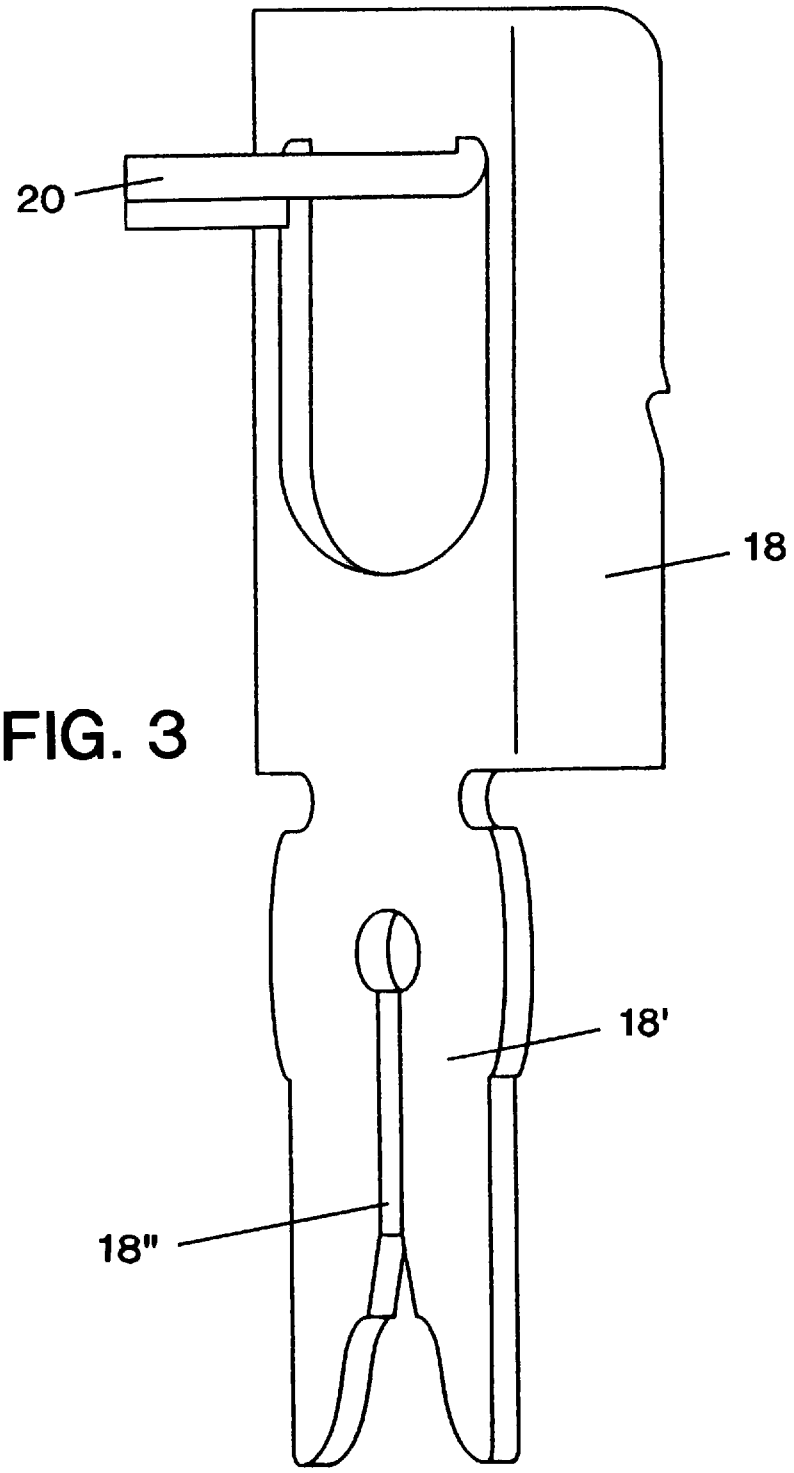
FIG. 3. is a perspective view, on an enlarged scale, of a stationary connector/contact the switch of FIGS. 1 and 2.

In accordance with the present invention, the main portion 2 of housing 1 is provided, on each of its four lateral sides, with a mounting fastener receiver in the form of a cut-out or recess as indicated at 6 in FIG. 1. The 6 fastener receivers are sized and shaped to accept mounting screws, not shown, and are located with their axes in a common plane which is desirably located approximately mid-way between the opposite ends of switch housing 1, the common plane being transverse to axis A—A. The fastener receivers 6 extend completely across the respective sides of housing portion 2 and are open at both ends. A safety switch in accordance with the present invention is capable of being mounted on a support surface, i.e., a wall or the like, by means of a pair of screws which are received in an oppositely disposed pair of the receivers 6. The receivers 6 are expediently provided, at each end thereof, with a counter-sink 7 for receiving the head of a mounting screw.

As depicted in FIG. 1, the mounting screw receiving recesses 6 can be in the form of peripheral, outwardly open grooves. Alternatively, as depicted in FIG. 2, the fastener receiving recesses may be provided with outer covers, i.e., may be in the form of bores or through-holes 6*a*. The covers, if employed, may be integral with the upper end cap 5.

The upper end cap 5 is provided, in both a end and the side thereof, with a slot-like actuator introduction orifice having parallelly aligned lateral edges. The orifice 8 in the end wall of end cap 5 will be adjacent to the side wall of cap 5 which is disposed oppositely with respect to the side wall having the other, i.e., the lateral, actuator introduction orifice 8'. Orifice 8 also, as clearly shown in FIG. 2, defines a plane oriented generally parallel with respect to this oppositely disposed side wall. In the embodiment being described, at least the end cap side wall which has the actuator introduction orifice 8' and the oppositely disposed side wall will be interlocked with the main portion 2 of housing 1 by means of cooperating projections on housing portion 2 and openings in end cap 5 as may be seen from FIG. 2.

The main portion 2 of housing 1 receives and supports an axle 9. Axle 9 is held in position, as shown FIGS. 1 and 4*c*, by means of transversely oriented pins 10 which are press fit into receiving apertures in lateral recesses 11 of housing portion 2. The pins 10 preferably also extend through and engage a pair of opposite sidewalls of the upper end cap 5 and thus assist in preventing unauthorized removal of cap 5.

An actuating roller 12, i.e., an assembly or device which translates the insertion motion of an actuator "key" to motion of a switch contact, is rotatably mounted on axle 9. Roller 12 is comprised of a plurality of individually rotatable discs 23 which cooperate to define, on the outer circumference of roller 12, at least a pair of radially inwardly extending recesses 13. With roller 12 oriented as shown in FIG. 2, the recesses 13 are located in registration with respective of the actuator introduction orifices 8 and 8'. Accordingly, when a coded actuator 14, see FIG. 4*a*, is introduced into one of the introduction orifices, the roller 12 will be caused to rotate in the direction of arrow 15 (FIG. 2).

A contact carrier is associated with, and caused to move linearly in response to rotation of, the roller 12. This contact carrier includes a reciprocally movable "tappet" 16. Tappet 16 is guided, i.e., its motion is constrained to be linear, in housing 1 generally along the longitudinal axis A—A. Tappet 16 carries a pair of movable electrical contacts 17 which, in the disclosed embodiment, are short-circuited. Each of the movable contacts 17 cooperates with a stationary electrical contact 20 provided at the upper end of an electrically conductive connector 18 which is affixed to the housing.

The lower cover 4 defines a nipple 19 which is sized and shaped for the moisture proof introduction of a multi-conductor electrical cable, one of the conductors of such cable being indicated at 32 in FIG. 2. As best seen from FIG. 3, the connectors 18 are expediently designed to present knife-edge type contacts 18' at the end thereof disposed oppositely with respect to the integral contacts 20. Accordingly, when an insulated conductor 32 is introduced into the slot 18" between the contact blades 18', the connector will cut through the insulation and establish electrical contact with the underlying conductor. The connectors 18 will be formed from sheet-metal by stamping and bending.

The cooperating pairs of electrical contacts 17 and 20 are located in a portion of housing 1 which is sealed, to the extent possible, from the ambient atmosphere. This sealing is accomplished, in part, by means of a peripheral sealing ring 21 interposed between main housing portion 2 and lower cover 4. Additional hermetic isolation is provided by means of an accordion-like gasket 22 which is sealed, about the periphery of a central aperture therein, to tappet 16 and is sealed, at its outer periphery, to housing portion 2.

Figure 4C:
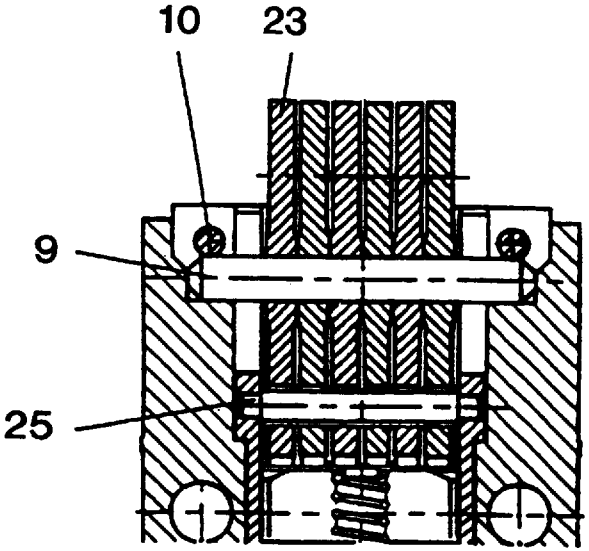
FIGS. 4*a*, 4*b* and 4*c* are, respectively, a perspective view of an actuator for the switch of FIGS. 1 and 2, a perspective view of the actuating roller of the switch of FIGS. 1 and 2 and a partial cross-sectional view depicting the mounting of the actuating roller of FIG. 4*b* in the housing of the switch of FIGS. 1 and 2.
Figure 4B:
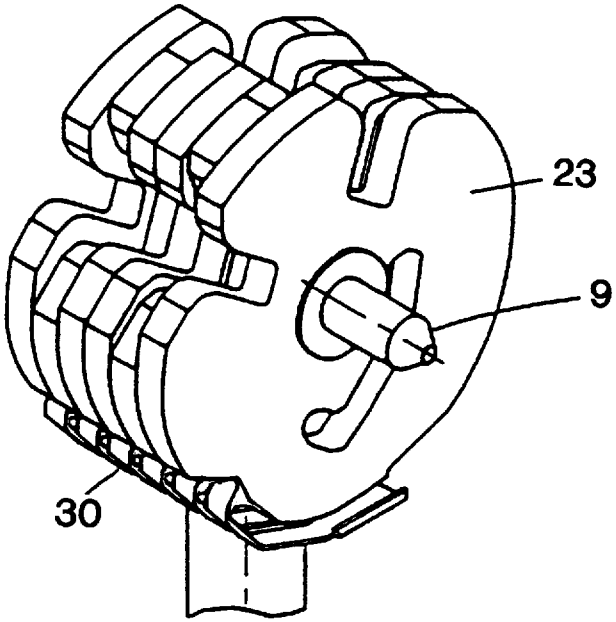
Figure 4A:
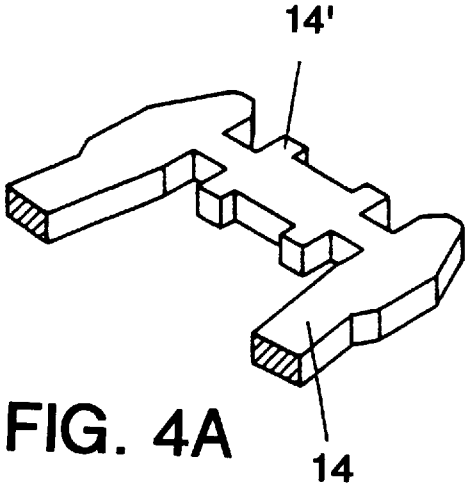

In the embodiment of FIGS. 1–4, as may best be seen from FIGS. 4*b* and 4*c*, the actuating roller 12 consists of a plurality of individual disks 23 mounted on axle 9 so as to be rotatable independently of one another. The disks 23 are provided with cut-outs of different shape for engagement with actuating portions 14' of the actuator 14, these cut-outs defining the radial recesses 13 in the roller 12. The irregular shape of the radial recesses 13, as established by the different disks 23, defines the access "code" for operating the safety switch which must be present on the actuator 14.

Referring to FIG. 2, aligned and identically shaped non-linear cam slots 24 extend through all of the disks 23. A pin 25, which is oriented with its axis parallel to axle 9, extends through the aligned slots 24. Pin 25 is received in a yoke-like extension 26 of tappet 16.

Movement of extension 26, and thus of tappet 16, is guided by main portion 2 of housing 1. The tappet and its yoke extension are shown at the limit of motion in the downward direction in FIGS. 1 and 2.

A further yoke member 27 is fixedly mounted on axle 9. Yoke 27 is provided with elongated guide holes 28 in which the opposite ends of pin 25 are received. A compression spring 29 extends between a stop on yoke 27 and the bottom of a spring-receiving recess in the upper end of tappet 16. Spring 29, accordingly, biases tappet 16 in the direction of the lower cover 4 and thus, in the disclosed embodiment, biases the switch contacts 17, 20 to a normally closed state.

Through the cam-like cooperation between the walls of the aligned slots 24 in discs 23 and pin 25, actuator induced rotation of roller 12 will result in pin 25 being pulled in the direction of the upper cap 5. Accordingly, in response to insertion of a properly coded actuator 14 into either of slots 8 or 8', tappet 16 will pull contacts 17 away from contacts 20, against the bias of spring 29, to thereby change the state of the switch.

Referring to FIGS. 2 and 4*b*, the assumption of a neutral or initial position of disks 23 is accomplished through the action of a comb-like leaf spring 30 mounted on yoke 27. The active portions of the spring elements of spring 30 engage circumferential recesses 31 in the disks 23 upon withdrawal of the actuator 14 from an introduction orifice 8 or 8'.

The interposition of the compression spring 29 between the tappet 16 and a stop fixed to the housing, i.e., a reaction surface located on yoke 27 adjacent to roller 12, leads to a reduction in the length of housing 1 in its longitudinal direction.

It should be noted that, in an alternative construction, the cam drive, i.e., coupling, pin 25 can be connected to tappet 16 via connecting rods. However, this alternative construction will result in a lengthening of the housing 1.

The cover 4 is provided, on its inner surface, with two pair of spaced webs 33. The webs 33 receive the insulated conductors 32 of the electrical cable inserted in nipple 19. Each pair of webs defines a recess 34 in which an insulated conductor 32 will be captured upon insertion. The pushing of the cover 4 onto the main portion 2 of the housing, and the subsequent fastening of the cover 4 to housing portion 2 by means of the screws 32, will result in the knife edge contacts 18' penetrating between two adjacent pairs of webs 33 in a direction transversely to the conductor 32, so as to slice through the insulation of or captured conductor 32 and establish the desired electrical contact. In the disclosed embodiment, the double pairs of webs 33 are arranged in opposite corners of the cover 4 so that the conductors 32 will be directed in diagonal directions.

Figure 5:
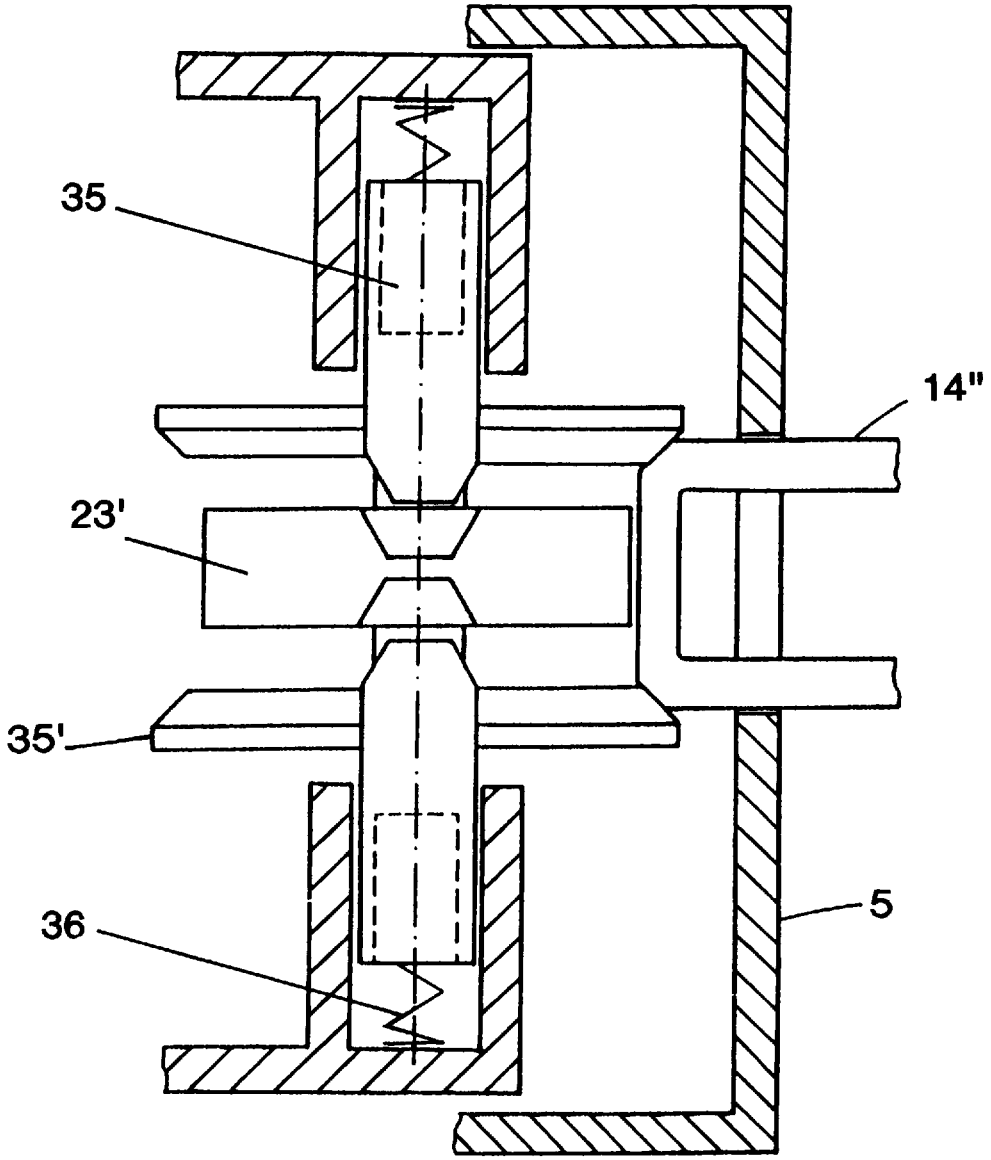
FIG. 5. is a partial cross-sectional top elevation view, on an enlarged scale, of a switch in accordance with a second embodiment of the invention.

Referring to FIG. 5, in accordance with an alternative construction, the actuating roller 12 may in the form of a single rotatable member 23' rather than a plurality of individually rotatable disks. In the FIG. 5 embodiment, a pair of "bolts" 35 are arranged on opposite sides of roller 23' and offset from the axle about which the disk rotates. The roller is provided with recesses having shapes which are complementary to the configuration of the ends of "bolts" 35. The "bolts" 35 are spring biased in the direction of actuating roller 23' by means of springs 36. When the shaped ends of the "bolts" 35 engage the complementary shaped recesses in actuating roller 23', the actuating roller is locked against rotation. An unlocking disk 35' is fixed to each "bolt" 35 and these unlocking disks are provided with camming surfaces, facing an actuator introduction orifice, which at least in part define the "code" of the switch. As a result of the introduction of the appropriate actuator 14", the actuator engaging the cam surfaces on the unlocking disks, the "bolts" 35 are forced axially outwardly as shown in FIG. 5 and the actuating roller 23' is unlocked and subsequently rotated by continued insertion of the actuator. In an alternative construction, the bolts 35 may be radially oriented with respect to the actuating roller.

Figure 6:
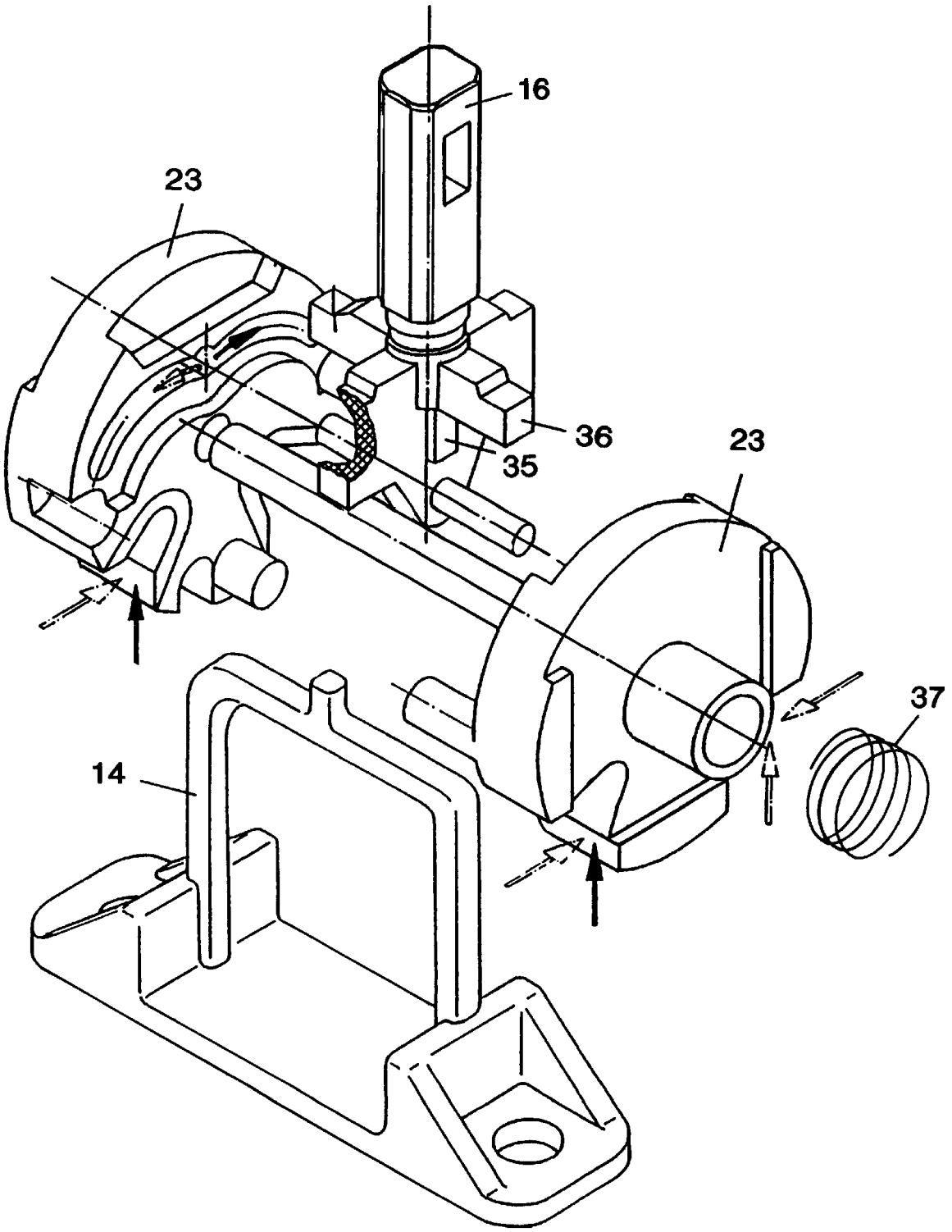
FIG. 6. is a partial perspective view, partly in section, of a third embodiment of a switch in accordance with the invention, the orientation of the switch of FIG. 6 being rotated 180° with respect to the switch of FIGS. 1 and 2.

FIG. 6 depicts a third embodiment of the invention wherein, rather than employing the lateral "bolts" 35 of the FIG. 5 embodiment, a stationary bolt 36 is utilized. In the FIG. 6 embodiment, each disk 23 of the actuating roller may be pressed axially outwardly into an actuating position in opposition to force provided by a spring 37. A safety switch of the same general construction is shown in above referenced U.S. No. Pat 4,658,102.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A safety switch comprising:

a switch housing, said housing having a longitudinal axis and a cross-section transverse to said housing axis which is substantially square, said housing also having four side walls and a pair of oppositely disposed end wall said side walls each having a length;

motion translating means disposed within said housing, said motion translating means including a roller having an outer circumference, said roller being mounted for rotation about a first axis;

a contact carrier reciprocally mounted within said housing, said contact carrier being coupled to said roller and moving in response to rotation of said roller, said contact carrier supporting at least a first movable electrical contact;

a stationary switch contact mounted in said housing for cooperation with said first movable electrical contact;

means for imparting rotation to said roller, said rotation imparting means including at least a first actuator introduction orifice provided in a wall of said housing, said orifice being in registration with said roller, said rotation imparting means also including an external and separable actuator which may be inserted into said housing through said orifice and into contact with said motion translating means roller to impart rotation to said roller; and means for mounting said housing, said mounting means including a an elongated fastener receiver located adjacent to each of said housing side walls, said receivers each having an axis located intermediate said housing end walls, said axes being coplanar and defining a plane oriented substantially transversely with respect to said housing longitudinal axis, said receivers each having a pair of oppositely disposed ends arranged on its respective axis, said receivers each being open at each end thereof and being sized to accommodate an elongated mechanical fastener.

2. The safety switch of claim 1 wherein said mounting means further comprises:

a countersink at each end of each of said receivers.

3. The safety switch of claim 1 wherein said mounting means receivers each comprise:

an outwardly open groove in the said adjacent side wall of said housing.

4. The safety switch of claim 1 wherein said mounting means receivers each comprise:

a bore which extends the length of the said adjacent side wall of said housing.

5. The safety switch of claim 1 wherein said rotation imparting means actuator introduction orifice is located in a first wall of said housing and wherein said rotation imparting means further includes a second actuator introduction orifice located in a second wall of said housing, said actuator introduction orifices being arranged relative to one another so as to permit rotation of said roller in a first direction upon introduction of said actuator into either of said orifices.

6. The safety switch of claim 1 wherein a detent recess is provided along the circumference of said actuating roller and said switch further comprises:

positioning spring means for engaging said detent recess, said positioning spring means biasing said actuating roller to an initial position.

7. The safety switch of claim 1 wherein said switch housing comprises:

a middle portion having oppositely disposed first and second ends, said mounting means receivers being provided on said middle portion, said roller being mounted on said middle portion;

an end cover extending from a first of said middle portion ends, said end cover defining a first of said housing end walls; and an end cap mounted on and extending from the second of said middle portion ends, said end cap defining the second of said housing end walls, said actuator introduction orifice being located in said end cap.

8. The safety switch of claim 7 wherein said end cover is removably affixed to said housing middle portion and wherein said housing further includes:

means for establishing a hermetic seal between said end cover and said middle portion; and means for establishing a hermetic seal between said housing middle portion and said contact carrier.

9. The safety switch of claim 7 wherein said end cap engages said housing middle portion by means of cooperating projections and recesses.

10. The safety switch of claim 7 wherein said contact carrier is guided for linear motion by said housing middle portion.

11. The safety switch of claim 7 further comprising:

a second stationary switch contact, said stationary contacts each including a connector having a switch contact defining portion at a first end thereof and electrical conductor engaging jaws at a second end thereof, said jaws defining knife-edge contacts.

12. The safety switch of claim 11 wherein insulated electrical conductors are forced between said jaws by installation of said end cover on said housing middle portion.

13. The safety switch of claim 12 wherein said end cover includes:

two spaced pair of webs for each of said connectors, the webs of each pair defining a capture recess for one of said insulated electrical conductors, said knife-edge contacts being inserted between said pairs of webs.

14. The safety switch of claim 13 wherein said pairs of webs are arranged in corners of said end cover to establish a diagonal alignment of said electrical conductor capture recesses.

15. The safety switch of claim 1 wherein said contact carrier comprises:

a tappet member having a pair of oppositely disposed ends, said first movable electrical contact being supported from said tappet member at said first end thereof;

a yoke affixed to and extending from said second end of said tappet member;

a pin engaging said yoke member, said pin being oriented parallel to said first axis whereby said pin is moveable toward and away from said first axis in response to reciprocal movement of said contact carrier; and wherein said motion translating means roller includes:

a cam slot, said pin engaging said cam slot to thereby couple said contact carrier to said roller.

16. The safety switch of claim 1 wherein said motion translating means roller comprises:

an axle;

a plurality of disks mounted on said axle for rotation independently of one another, said discs cooperating to define a switch actuator code for said separable actuator, said actuator code being formulated by a pair of radial recesses which communicate with the outer circumference of each disk, said radial recesses being located so as to place a first of said recesses in registration with said actuator introduction orifice with the disk in a first position.

17. The safety switch of claim 1 further comprising:

at least a first lock member movably supported in said housing, said first lock in a first position thereof engaging said roller to prevent rotation thereof;

means for resiliently biasing said lock member into said first position; and means for imparting motion to said lock member in opposition to the bias of said resilient biasing means in response to introduction of said actuator into said introduction orifice.

18. The safety switch of claim 1 wherein said motion translating means further comprises:

an axle;

a plurality of disks mounted on said axle for rotation independently of one another, said disks cooperating to define said roller, a pair of said disks being disposed at opposite ends of said roller; and means for resiliently biasing said disks of said pair inwardly into a normally locked position, said disks of said pair being moved out of said locked position in response to introduction of said actuator into said introduction orifice.

19. The safety switch of claim 1 further comprising:

a second stationary switch contact, said stationary contacts each including a connector having a switch contact defining portion at a first end thereof and electrical conductor engaging jaws at a second end thereof, said jaws defining knife-edge contacts.

20. A safety switch comprising:

a switch housing, said housing having a longitudinal axis and a cross-section transverse to said housing axis which is substantially square, said housing also having four side walls and a pair of oppositely disposed end walls, said side walls each having a length, said housing further having a pair of oppositely disposed interior recesses;

motion translating means disposed within said housing, said motion translating means including a roller, said motion translating means further including an axle having a pair of oppositely disposed ends, said axle defining a first axis, said axle opposite ends being positioned in respective of said housing interior recesses, said roller being mounted on said axle for rotation about said first axis, said motion translating means additionally including pins for retaining the ends of said axle in said housing interior recesses;

a contact carrier reciprocally mounted within said housing, said contact carrier being coupled to said roller and moving in response to rotation of said roller, said contact carrier supporting at least a first movable electrical contact;

a stationary switch contact mounted in said housing for cooperation with said first movable electrical contact;

means for imparting rotation to said roller, said rotation imparting means including at least a first actuator introduction orifice provided in a wall of said housing, said orifice being in registration with said roller, said rotation imparting means also including an external and separable actuator which may be inserted into said housing through said orifice and into contact with said roller to impart rotation to said roller; and means for mounting said housing, said mounting means including an elongated fastener receiver located adjacent to each of said housing side walls, said receivers each having an axis located intermediate said housing end walls, said axes being coplanar and defining a plane oriented substantially transversely with respect to said housing longitudinal axis, said receivers each having a pair of oppositely disposed ends arranged on its respective axis, said receivers each being open at each end and being sized to accommodate an elongated mechanical fastener.

21. A safety switch comprising:

a switch housing, said housing having a longitudinal axis and a cross-section transverse to said housing axis which is substantially square, said housing also having four side walls and a pair of oppositely disposed end walls, said side walls each having a length, said housing further having an internal stop;

motion translating means disposed within said housing, said motion translating means including a roller, said roller being mounted for rotation about a first axis;

a contact carrier reciprocally mounted within said housing, said contact carrier being coupled to said roller and moving in response to rotation of said roller, said contact carrier supporting at least a first movable electrical contact;

a stationary switch contact mounted in said housing for cooperation with said first movable electrical contact;

means for imparting rotation to said roller, said rotation imparting means including at least a first actuator introduction orifice provided in a wall of said housing, said orifice being in registration with said roller, said rotation imparting means also including an external and sperable actuator which may be inserted into said housing through said orifice and into contact with said motion translating means roller to impart rotation to said reller;

means for resiliently biasing said reciprocal contact carrier in a direciton away from said first axis, said biasing means extending between said contact carrier and said housing stop, rotation of said motion translating means roller causing movement of said contact carrier in a direction opposite to the bias of said resilient biasing means; and means for mounting said housing, said mounting means including an elongated fastener receiver located adjacent to each of said housing side walls, said receivers each having an axis located intermediate said housing end walls, said axes being coplanar and defining a plane oriented substantially transversely with respect to said housing longitudinal axis, said receivers each having a pair of oppositely disposed ends arranged on its respective axis, said receivers each being open at each end and being sized to accommodate an elongated mechanical fastener.

* * * * *

UNITED STATES PATENT AND TRADEMARK OFFICE

CERTIFICATE OF CORRECTION

PATENT NO. : 5,821,484
DATED : October 13, 1998
INVENTOR(S) : Schulze et al.

It is certified that error appears in the above-identified patent and that said Letters Patent is hereby corrected as shown below:

Column 6,
Line 2, before "said" delete "wall" and insert -- walls, --.
Line 24, before "an" delete "a".
Line 39, before "adjacent" delete "said".
Line 43, before "adjacent" delete "said".

Column 10,
Line 2, delete "sperable" and insert -- separable --.
Line 5, delete "reller" and insert -- roller --.

Signed and Sealed this

Eighth Day of October, 2002

*Attest:*

*Attesting Officer*

JAMES E. ROGAN
*Director of the United States Patent and Trademark Office*